US012590501B2

(12) United States Patent
Marr et al.

(10) Patent No.: US 12,590,501 B2
(45) Date of Patent: Mar. 31, 2026

(54) SURFACE SWIVEL FOR WELLHEAD ORIENTATION

(71) Applicant: INNOVEX DOWNHOLE SOLUTIONS, INC., Humble, TX (US)

(72) Inventors: Graeme Marr, Humble, TX (US); Nicolas Sluys, Humble, TX (US); Alagappan Viswanathan, Humble, TX (US)

(73) Assignee: INNOVEX DOWNHOLE SOLUTIONS, INC., Humble, TX (US)

( * ) Notice: Subject to any disclaimer, the term of this patent is extended or adjusted under 35 U.S.C. 154(b) by 0 days.

(21) Appl. No.: 19/082,842

(22) Filed: Mar. 18, 2025

(65) Prior Publication Data

US 2025/0305381 A1 Oct. 2, 2025

Related U.S. Application Data

(60) Provisional application No. 63/570,887, filed on Mar. 28, 2024.

(51) Int. Cl.
*E21B 33/04* (2006.01)
*E21B 33/038* (2006.01)

(52) U.S. Cl.
CPC ..... *E21B 33/0415* (2013.01); *E21B 33/038* (2013.01)

(58) Field of Classification Search
CPC ..... E21B 33/0415; E21B 33/038
See application file for complete search history.

(56) References Cited

U.S. PATENT DOCUMENTS

| | | | | |
|---|---|---|---|---|
| 5,332,043 | A * | 7/1994 | Ferguson | E21B 33/0422 285/123.1 |
| 5,996,712 | A | 12/1999 | Boyd | |
| 9,909,385 | B2 * | 3/2018 | Cocker, III | E21B 33/14 |
| 10,036,485 | B2 * | 7/2018 | Adams | F16K 31/12 |
| 10,781,646 | B2 * | 9/2020 | Leiper | E21B 37/00 |
| 11,905,784 | B2 * | 2/2024 | Chiverton | E21B 33/0415 |

OTHER PUBLICATIONS

Combined Search and Examination Report dated Jun. 19, 2025, GB Application No. 2504012.2, 7 pages.

* cited by examiner

*Primary Examiner* — Tara Schimpf
*Assistant Examiner* — Daniel T Craig
(74) *Attorney, Agent, or Firm* — MH2 Technology Law Group, LLP

(57) ABSTRACT

A surface swivel for use in a wellhead includes a mandrel configured to be connected to a first wellhead component. The surface swivel also includes a sub configured to be connected to a second wellhead component. A portion of the mandrel is positioned within the sub and another portion extends axially from the sub. A bore extends radially through the sub. The surface swivel also includes a connector configured to extend radially through the sub and to engage the mandrel so as to prevent relative rotation between the mandrel and the sub while the mandrel is being connected to the first wellhead component, while the sub is being connected to the second wellhead component, or both. The connector is configured to be removed from engagement with the mandrel so as to allow rotation between the mandrel and the sub.

17 Claims, 9 Drawing Sheets

SURFACE SWIVEL FOR WELLHEAD ORIENTATION

CROSS-REFERENCE TO RELATED APPLICATIONS

This application claims benefit of U.S. Provisional Patent Application No. 63/570,887, which was filed on Mar. 28, 2024, and is incorporated herein by reference in its entirety.

BACKGROUND

A wellhead is a system of spools, valves and assorted adapters that provide pressure control for a production well. The wellhead may include a casing head housing and a landing system hanger. During the wellhead installation process, the casing head housing is to be orientated relative to the landing system hanger. Therefore, there is a need for a device to assist in the orientation of the casing head housing relative to the landing system hanger.

SUMMARY

A surface swivel for use in a wellhead is disclosed. The surface swivel includes a mandrel configured to be connected to a first wellhead component. The surface swivel also includes a sub configured to be connected to a second wellhead component. A portion of the mandrel is positioned within the sub and another portion extends axially from the sub. A bore extends radially through the sub. The surface swivel also includes a connector configured to extend radially through the sub and to engage the mandrel so as to prevent relative rotation between the mandrel and the sub while the mandrel is being connected to the first wellhead component, while the sub is being connected to the second wellhead component, or both. The connector is configured to be removed from engagement with the mandrel so as to allow rotation between the mandrel and the sub.

In another embodiment, the surface swivel includes a sub configured to be connected to a first wellhead component. The sub defines a plurality of locking pin bores radially therethrough. The surface swivel also includes a mandrel configured to be connected to a second wellhead component. The mandrel is received at least partially within the sub so as to form a flowpath through the sub and the mandrel. The mandrel defines a plurality of holes extending at least partially therein. The holes are axially aligned with the locking pin bores. The surface swivel also includes a plurality of connectors received through circumferentially-aligned pairs of the locking pin bores and into the holes. The plurality of connectors are configured to provide a torque-transmitting connection between the sub and the mandrel, and are removable to permit relative rotation between the sub and the mandrel. The plurality of connectors are configured to lock the swivel at a plurality of discrete, separate locations and not between the plurality of discrete, separate locations.

A method for making-up and operating a wellhead is also disclosed. The method includes connecting a sub of a swivel to a first wellhead component. The method also includes connecting a mandrel of the swivel to a second wellhead component. A bore extends through the sub. A hole is defined at least partially in the mandrel and aligned with the bore. A connector extends through the bore and into the hole so as to prevent relative rotation between the sub and the mandrel while the swivel is being connected to the first and second wellhead components. The method also includes removing the connector from the swivel after the swivel is connected to the first and second wellhead components, so as to permit relative rotation between the mandrel and the sub.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
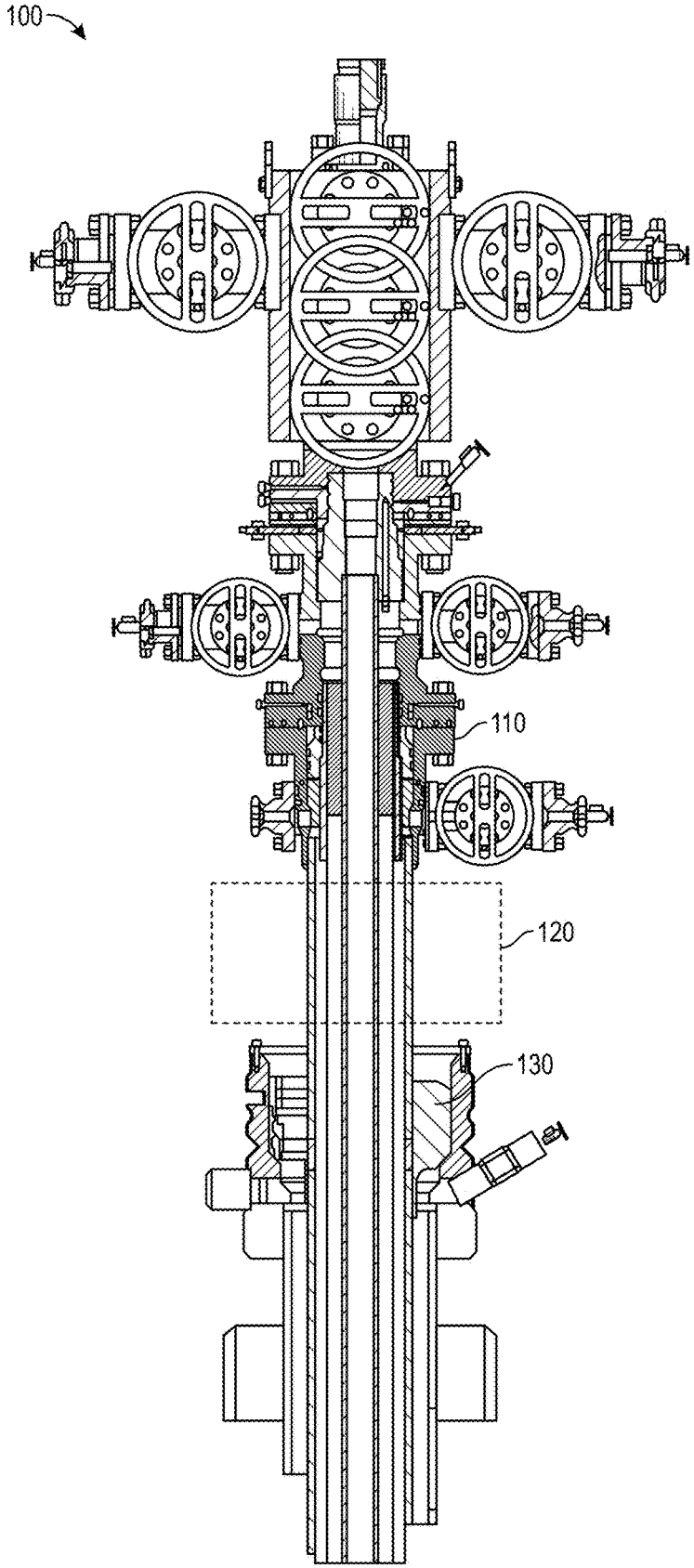
FIG. 1 illustrates a cross-sectional side view of a wellhead, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a cross-sectional side view of a wellhead 100, according to an embodiment. The wellhead 100 may include a casing head housing (CHH) 110 and landing system hanger 130. The wellhead 100 may also include a swivel 200 (see FIG. 2) that is coupled to the CHH 110. Although not shown in FIG. 1, the swivel 200 may be placed within the dashed box 120 below the CHH 110. The CHH 110 may be aligned with a cellar window while achieving a specified torque when making up the assembly to a previously-landed intermediate casing. The swivel 200 may be connected below the casing head housing 110 to allow orientation on top of the landing system hanger 130. The swivel 200 may allow orientation of the CHH 110, under compression forces from the weight of the CHH 110 itself. It may, therefore, be fitted with a compression bearing. In an embodiment, a tension bearing may be omitted.

The length of the swivel 200 may be defined by the height at which the CHH 110 may be set (e.g., to ensure alignment with the cellar window). That length is relatively short, which prevents the swivel 200 from having necks long enough to allow tongs to be set for connections make-up. Therefore, the swivel top sub 220 (see FIGS. 2 and 3) may be gripped to allow the tool make-up to both the intermediate casing and the CHH 110. For one of those connections, the swivel 200 may be locked either temporarily and/or in a single direction to allow torque to be transferred between the housing and the mandrel parts of the tool.

As described above, the wellhead 100 may also include a landing system hanger 130 that is coupled to and/or positioned below the swivel 200. The swivel 200 may allow orientation on top of the landing system hanger 130.

Figure 2:
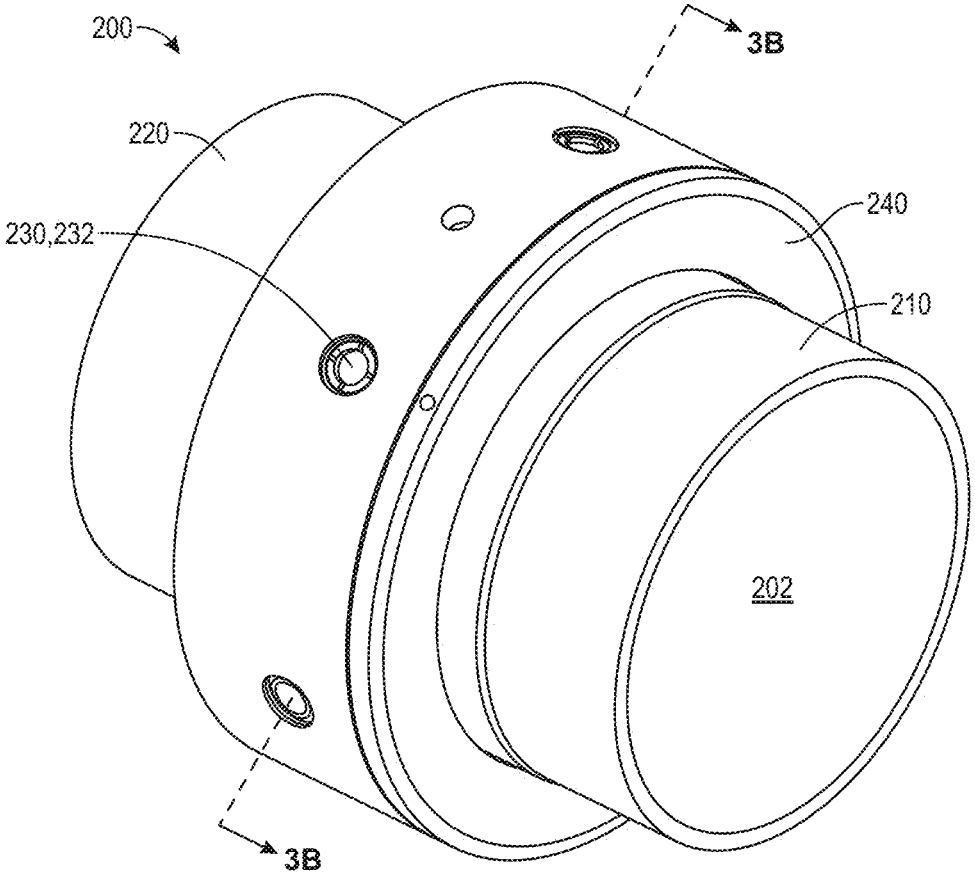
FIG. 2 illustrates a perspective view of a swivel that may be part of the wellhead, according to an embodiment.
Figure 3A:
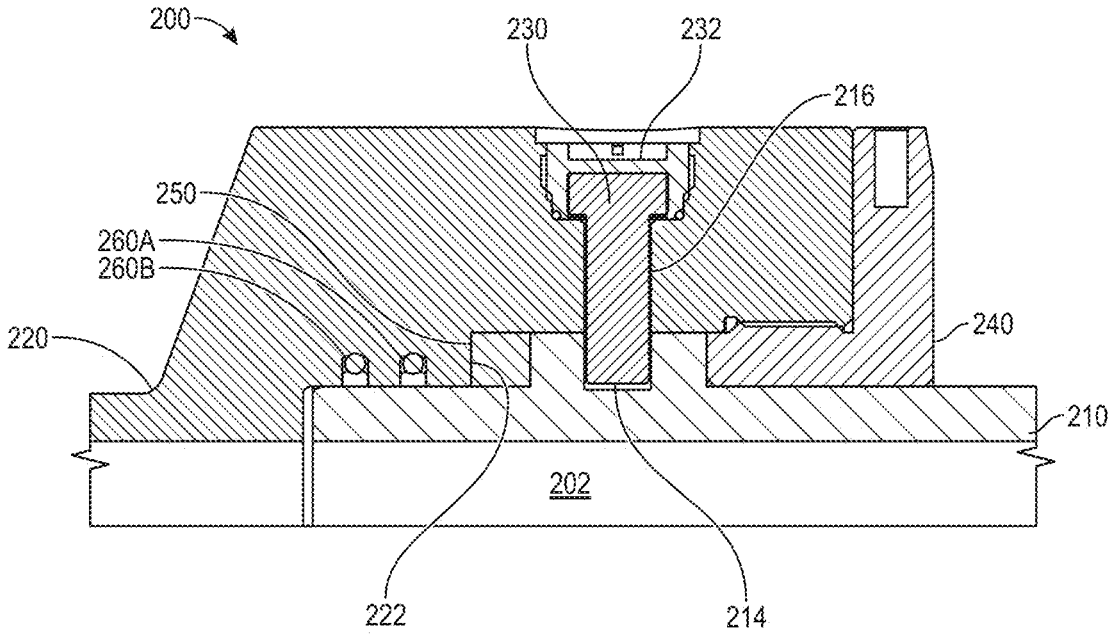
FIG. 3A illustrates a cross-sectional side view of the swivel, according to an embodiment.

FIG. 2 illustrates a perspective view of the swivel 200, and FIG. 3A illustrates a cross-sectional side view of the swivel 200, according to an embodiment. The swivel 200 may be or include a surface swivel for surface equipment orientation. In addition, the swivel 200 may allow a portion of the wellhead 100 to be rotated to align with other equipment. Conventional wellheads do not have this capability as they may rely on a section of casing to space out.

The swivel 200 may include a mandrel 210 and a top sub 220. The mandrel 210 may be positioned below the top sub 220. The mandrel 210 and the top sub 220 may be configured to be coupled together (as described below) and to define an axial bore 202 through which fluid may flow. The mandrel 210 may define a hole 214 extending radially therein. A plurality of such holes 214 may be present, sharing a common axial location, and located at one or more angular intervals around the mandrel 210, as will be described in greater detail below. The top sub 220 may include one or more locking pin bores 216 extending radially therethrough, e.g., at a common axial location and at one or more circumferential intervals. In at least some embodiments, when the swivel 200 is installed, the locking pin bores 216 and the holes 214 in the mandrel 210 may be axially-aligned.

The swivel 200 may include one or more connectors 230. The connectors 230 may be or include locking pins, as illustrated (and thus may be referred to herein as "locking pins 230"). The locking pins 230 may extend radially through the top sub 220 via the locking pin bores 216 and into the holes 214. Retainer caps 232 may be configured to retain the locking pins 230 in position to secure the mandrel 210 and the top sub 220 together. When the locking pins 230 are received in the holes 214, the locking pins 230 may transmit torque from the top sub 220 to the mandrel 210 via interaction with the locking pin bores 216 and the holes 214. Because the locking pins 230 transmit torque when they are received through respective, circumferentially-aligned pairs of locking pin bores 216 and holes 214, they permit the swivel 200 to be locked and thus transmit torque at a plurality of discrete, angularly-separated locations (i.e., orientations of the top sub 220 relative to the mandrel 210). When no locking pin bores 216 are circumferentially aligned with any holes 214, the locking pin 230 may not be received through both at the same time, and thus, between these discrete, angularly-separated locations, the swivel 200 may not be locked and thus may not transmit torque.

The retainer caps 232 may also be introduced into empty radial locking pin bores 216 (e.g., after the locking pins 230 have been removed therefrom), e.g., serving as plugs to prevent fluid and/or pressure communication through the locking pin bores.

In other embodiments, the connectors 230 may be bolts, which may be threaded into the locking pin bores 216 and/or the holes 214.

In another embodiment, the connectors 230 may be set screws, and the holes 214 may form a continuous groove into which the set screws may be received and may bear upon the mandrel 210. In still another embodiment, the connectors 230 may include teeth, wickers, or any other torque-transmitting connector. These embodiments may permit a continuous or infinite number of rotational orientations of the top sub 220 relative to the mandrel 210 to be locked.

As noted above, the connectors 230 may be considered to "lock" the swivel 200 (e.g., prevent rotation between the mandrel 210 and the top sub 220 when exposed to torque). As a result, the torque may be transferred through the swivel 200 to a different connection. For example, the torque may instead be used to connect the mandrel 210 to a lower wellhead component, or to connect the top sub 220 to an upper wellhead component.

Accordingly, the torque-transmission capability of the swivel 200 can be adjusted based on the number of connectors (e.g., locking pins) 230 employed. In a first configuration, for example, when making-up (connecting) the swivel 200 to an adjacent pipe or CHH 110 (e.g., FIG. 1), potentially all of the locking pin bores 216 may have one of the locking pins 230 installed therein, providing maximal torque-transmission (in other words, maximum locking) for the swivel 200. In another configuration, e.g., after make-up and orientation of the swivel 200 is complete, fewer locking pins 230 may be installed, leaving some of the locking pin bores 214 open (but optionally plugged with retainer caps 232 to maintain fluid-tight properties of the swivel 200). This may reduce the locking force, but such reduced locking force may be acceptable in view of reduced time to lock and a lower torque transmission need, while requiring fewer of the holes 216 to be aligned with the locking pin bores 214 to lock the swivel 200, which in turn may permit the swivel 200 to be locked at an increased number of angular orientations.

The swivel 200 may also include a bottom cap 240 that is positioned at least partially below the top sub 220. The bottom cap 240 may also or instead be positioned at least partially (e.g., radially) between the mandrel 210 and the top sub 220.

The swivel 200 may include a bearing 250 that is positioned axially and/or radially between the mandrel 210 and the top sub 220. More particularly, the bearing 250 may be positioned axially-between an upper surface of the mandrel 210 and a lower surface of an inner shoulder 222 of the top sub 220. The bearing 250 may allow the swivel 200 to rotate when it is under compression. In other words, the bearing 250 allows the mandrel 210 to rotate with respect to the top sub 220 while the swivel 200 is under compression.

The swivel 200 may also include one or more seals (two are shown 260A, 260B). The seals 260A, 260B may be or include elastomeric rotary seals. The seals 260A, 260B may be positioned radially-between the mandrel 210 and the top sub 220. The seals 260A, 260B may be positioned above the bearing 250. In another embodiment, the swivel 200 may include a sealing system that may include sealant injection ports.

Figure 3B:
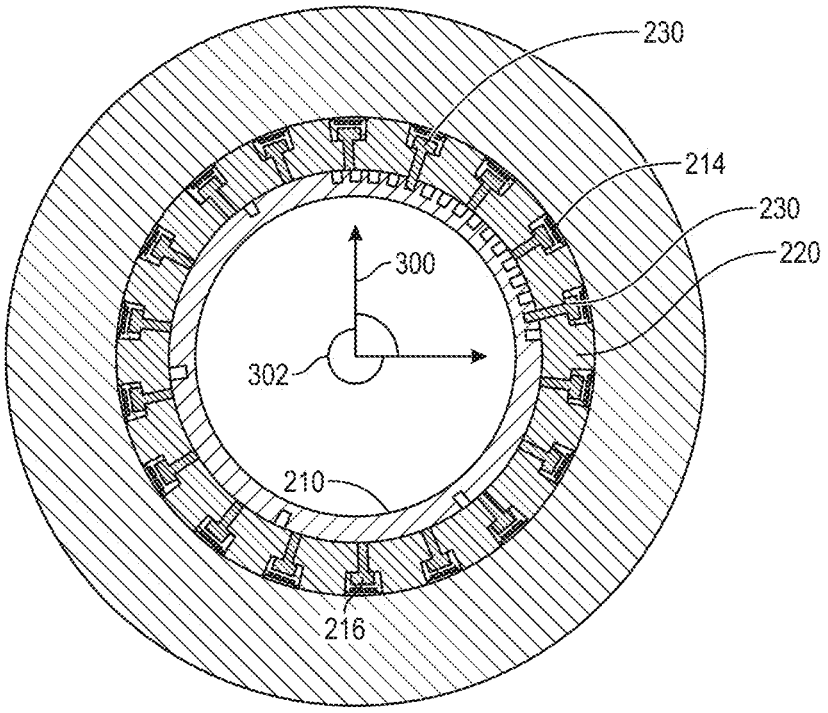
FIG. 3B illustrates an axial cross-sectional view of the swivel, according to an embodiment.

FIG. 3B illustrates an axial cross-sectional view of the swivel 200, according to an embodiment, e.g., along line 3B-3B of FIG. 2. As shown in FIG. 3B, the holes 214 may be defined at one or more angular intervals around the mandrel 210. Similarly, the locking pin bores 216 may be defined at one or more angular intervals. In at least some embodiments, there may be more holes 214 than locking pin bores 216. This may permit the locking pin bores 216 to be indexed as the top sub 220 rotates relative to the mandrel 210, so that the rest of the wellhead 100 FIG. 1) components reach a desired angular orientation. Upon reaching the desired angular orientation, one or more of the locking pin bores 216 may be aligned with a respective one or more of the holes 214, and a locking pin 230 received through the locking pin bore 216 into the hole 214.

In a specific embodiment, the holes 214 may not be located at a uniform angular interval around the mandrel 210. For example, as shown, the mandrel 210 may include a first angular range 300, e.g., of about 90 degrees, and a second angular range 302, e.g., of about 270 degrees. In the first angular range 300 the holes 214 may be closer together than the second angular range 302. In at least some embodiments, the locking pins 230 may be received through locking pin bores 216 aligned with holes 214 in the first angular range 300 and may not be received through locking pin bores 216 aligned with holes 214 in the second angular range 302. By contrast, in at least some embodiments, the locking pin bores 216 may be defined at generally uniform angular intervals.

The connectors (e.g., locking pins 230) received in aligned locking pin bores 216 and holes 214 may permit a control of the precise angular location of the top sub 220 relative to the mandrel 210, by providing many potential angular locations where a lock of the swivel 200 may be established. In some embodiments, two locking pins 230 may be received through respective locking pin bores 216 and into aligned holes 214. In other embodiments, any number of one or more locking pins 230 may be used. In various embodiments, the locking pins 230 may located in any of the locking pin bores 216.

Figure 4:
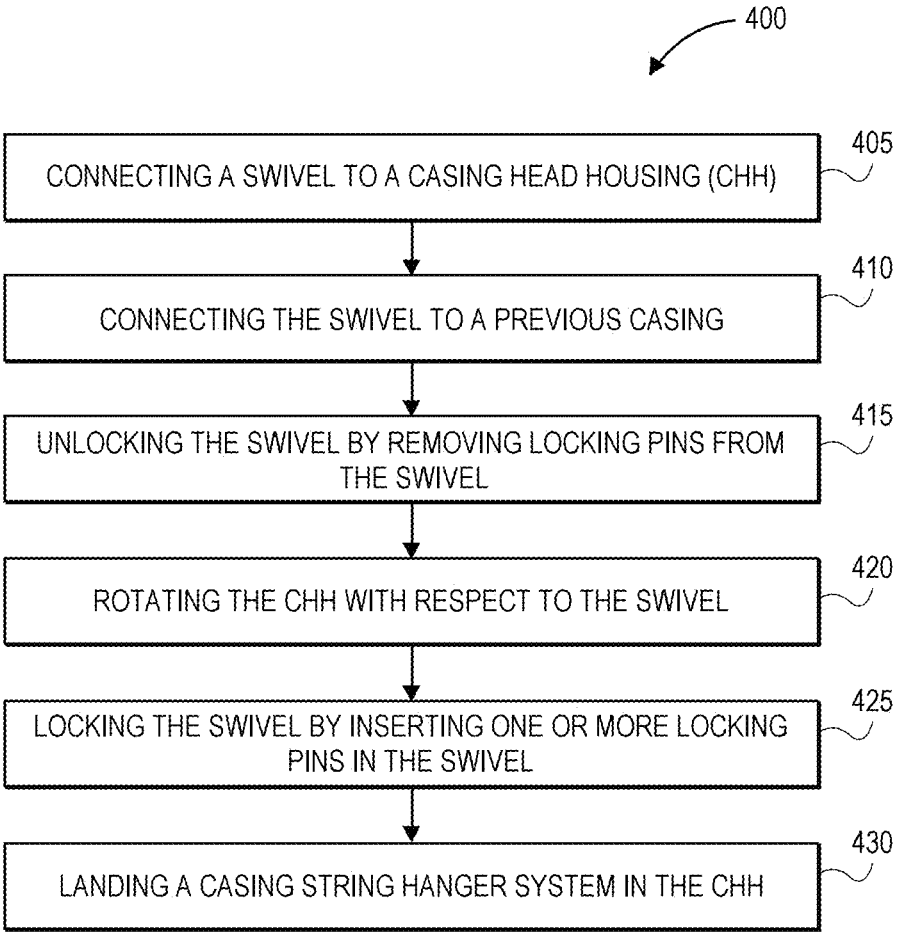
FIG. 4 illustrates a flowchart of a method for making-up and operating a wellhead that includes the swivel, according to an embodiment.

FIG. 4 illustrates a flowchart of a method 400 for making-up and/or operating the wellhead 100, according to an embodiment. An illustrative order of the method 400 is provided below; however, one or more steps of the method 400 may be performed in a different order, simultaneously, repeated, or omitted.

Figure 5:
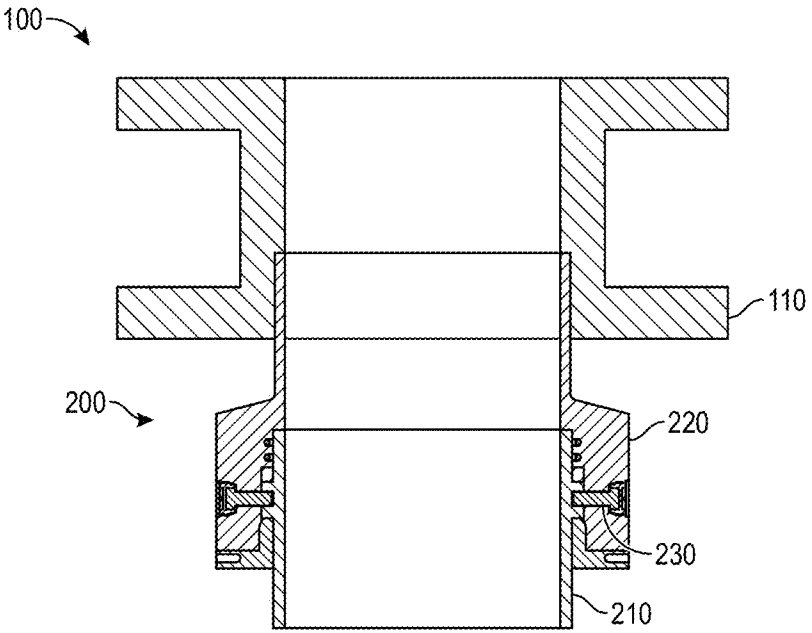
FIG. 5 illustrates a cross-sectional side view of the swivel connected to a casing head housing above it, according to an embodiment.
Figure 8:
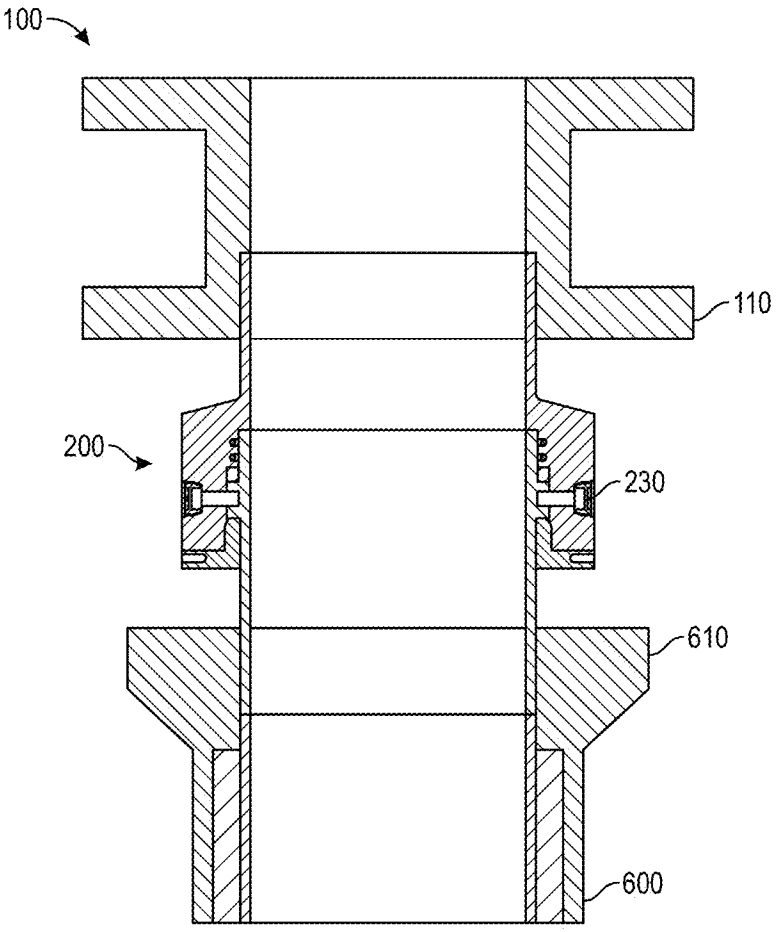
FIG. 8 illustrates a cross-sectional side view of the swivel with retainer caps installed, according to an embodiment.

The method 400 may include connecting the swivel 200 to an upper wellhead component (e.g., CHH 110), as at 405. This is shown in FIG. 5. The CHH 110 may be above the swivel 200. The CHH 110 may be connected to the outer surface of the top sub 220 of the swivel 200. This connection may be via a box-by-pin connection or a pin-by-pin connection. The CHH 110 and the swivel 200 may be connected by gripping the largest outer diameter portion of the swivel 200 and rotating/torquing the CHH 110 and/or the swivel 200 with respect to one another.

Figure 6:
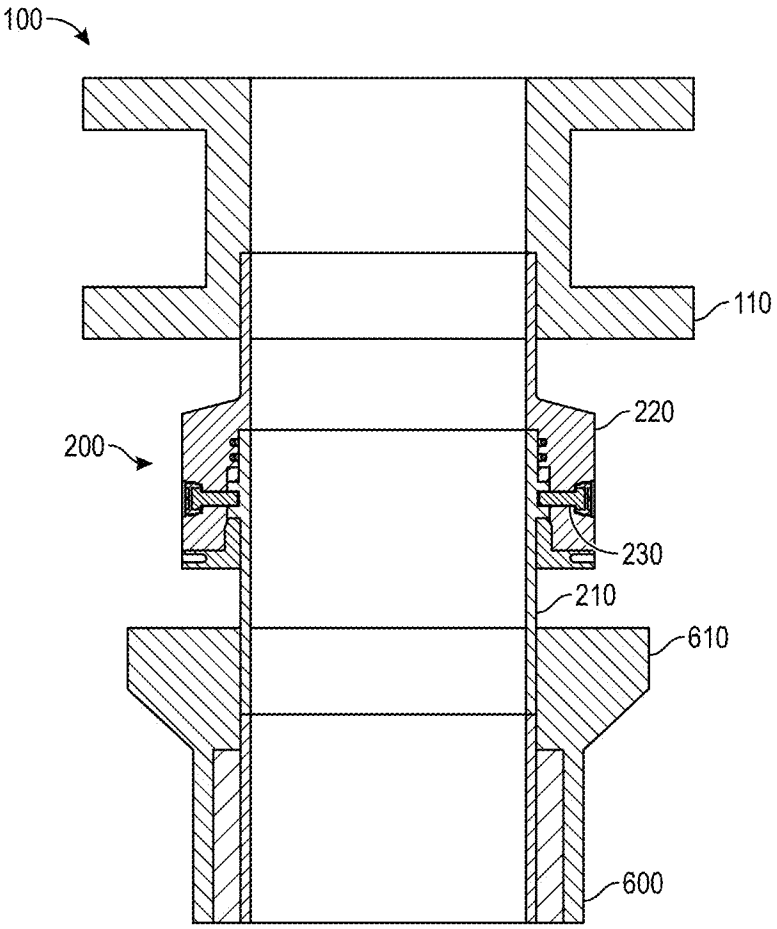
FIG. 6 illustrates a cross-sectional side view of the swivel connected to a previous casing below it, according to an embodiment.

The method 400 may also include connecting the swivel 200 to a lower wellhead component (e.g., a previous casing 600), as at 410. This is shown in FIG. 6. This may also or instead include connecting the swivel 200 to a previous casing landing base 610. The previous casing 600 and/or previous casing landing base 610 may be positioned below the swivel 200. This connection may be via a box-by-pin connection or a pin-by-pin connection. The previous casing 600 and/or previous casing landing base 610 may be connected to the outer surface of the mandrel 210 of the swivel 200. The connection may be made by gripping the largest outer diameter portion of the swivel 200 and transferring torque through the locking pins 230 into the mandrel 210. This may allow for make-up torque to be applied to the previous casing 600 and/or previous casing landing base 610.

In an embodiment, steps 405 and 410 may be performed in the reverse order so that the liner system hanger is made-up first. The swivel 200 may also be run inverted so that the mandrel 210 is made-up to the CHH 110. Threaded connections and/or weld-prep connections may be utilized.

Figure 7:
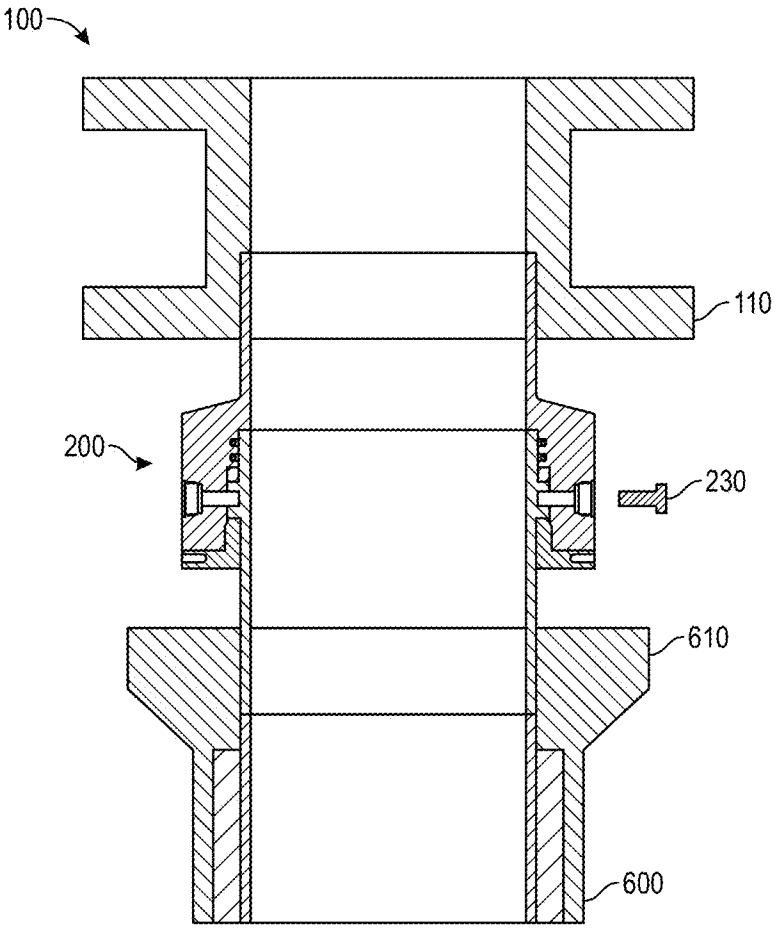
FIG. 7 illustrates a cross-sectional side view of the swivel with locking pins removed, according to an embodiment.

The method 400 may also include unlocking the swivel 200 by removing the locking pins 230 from the swivel 200, as at 415. This is shown in FIG. 7. The locking pins 230 may be removed after the connection(s) in step(s) 405 and/or 410 are made up. More particularly, once the swivel 200 has been torqued in place, the locking pins 230 may be removed from the radial locking pin bores to allow the mandrel 210 and the top sub 220 to rotate with respect to one another.

Figure 9:
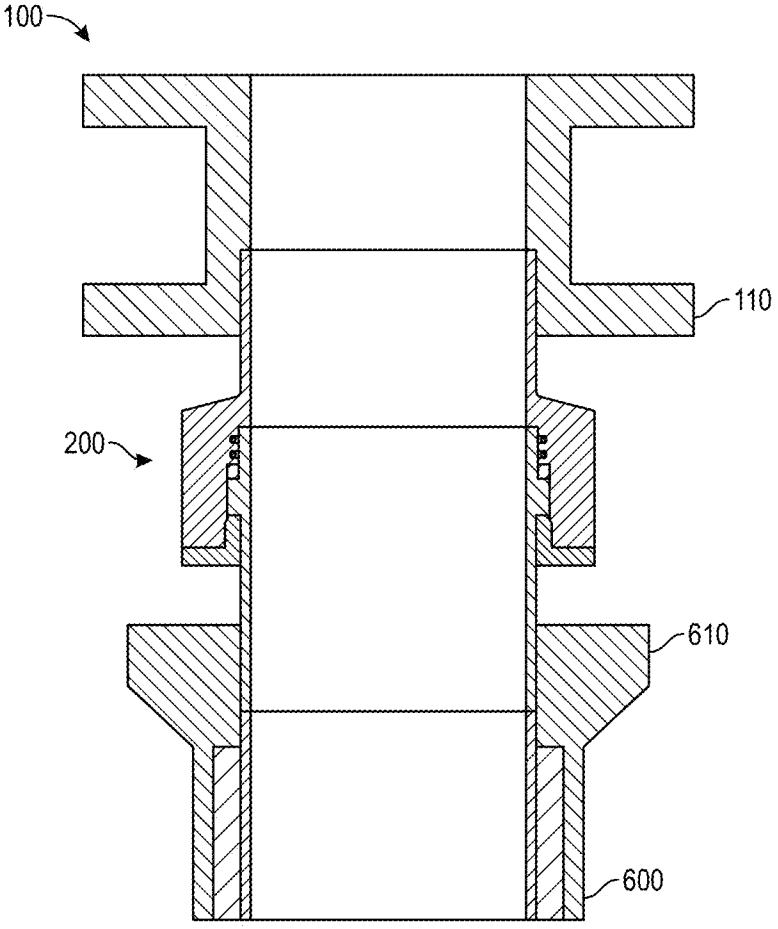
FIG. 9 illustrates a cross-sectional side view of the casing head housing being oriented (e.g., rotated) with respect to the swivel, according to an embodiment.

The method 400 may also include rotating the upper wellhead component (e.g., CHH 110) with respect to the lower wellhead component, as at 420. Said another way, once make-up is complete, the CHH 110 may be oriented on top of the swivel 200 to align as required. In an embodiment, this may include rotating the CHH 110 and the top sub 220 while the mandrel 210 and the previous casing 600 do not rotate. This is shown in FIG. 9, which is rotated for illustration purposes.

In one embodiment, the swivel 200 may be re-locked (e.g., by re-inserting and/or tightening the locking pins 230) once the desired orientation is achieved, as at 425. Subsequent to the orientation, the swivel 200 may sustain the weight from the wellhead 100 and/or production casing.

Figure 10:
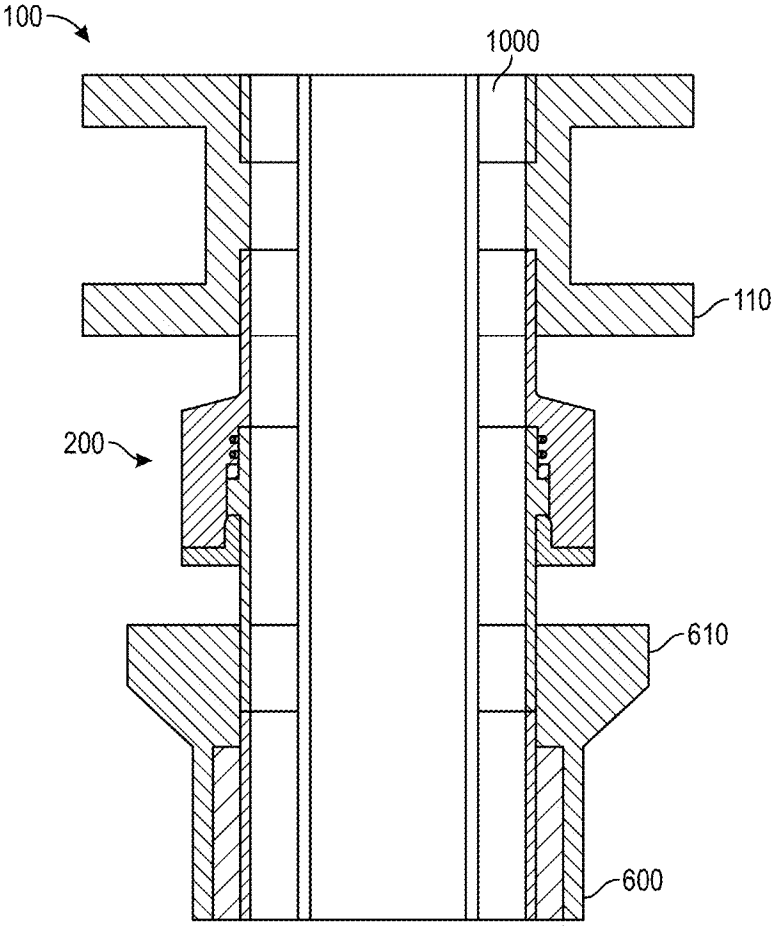
FIG. 10 illustrates a cross-sectional side view of a casing string hanger system landing in the casing head housing, according to an embodiment.

The method 400 may also include landing a (e.g., next) casing string hanger system 1000 in the upper wellhead component (e.g., CHH 110), as at 430. This is shown in FIG. 10. The swivel 200 may be locked or unlocked at this stage. The lock status may not affect the function of the CHH 110 and subsequent components.

Figure 11:
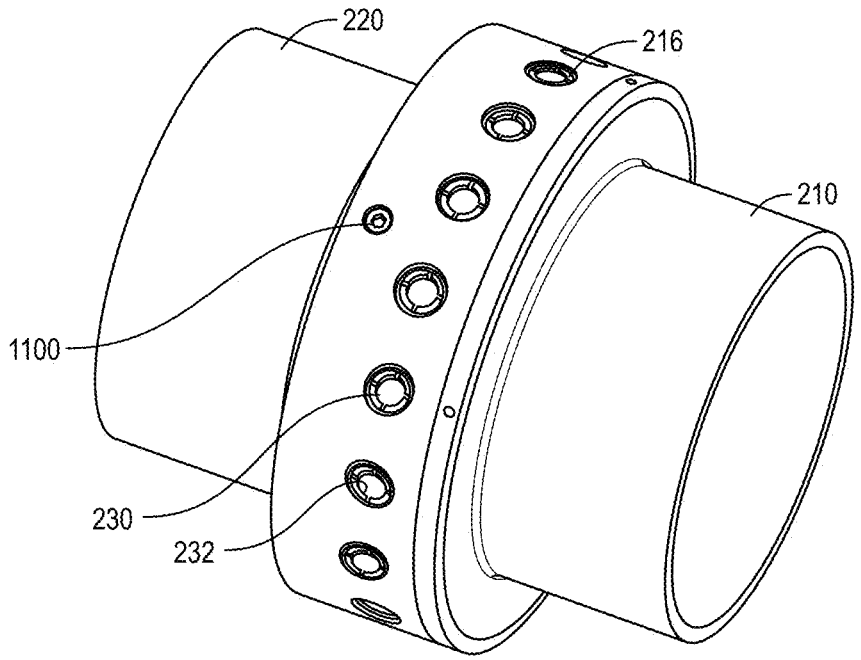
FIG. 11 illustrates a perspective view of another embodiment of the swivel.

FIG. 11 illustrates a perspective view of another embodiment of the swivel 200. In this embodiment, the swivel 200 may include an injection port 1100 extending radially through the top sub 220. In addition, the top sub 220 may include the locking pin bores 214, at least some of which may include a locking pin 230 extending therethrough so as to provide a torque-locking (and potentially axially-locking) connection with the mandrel 210.

Figure 12:
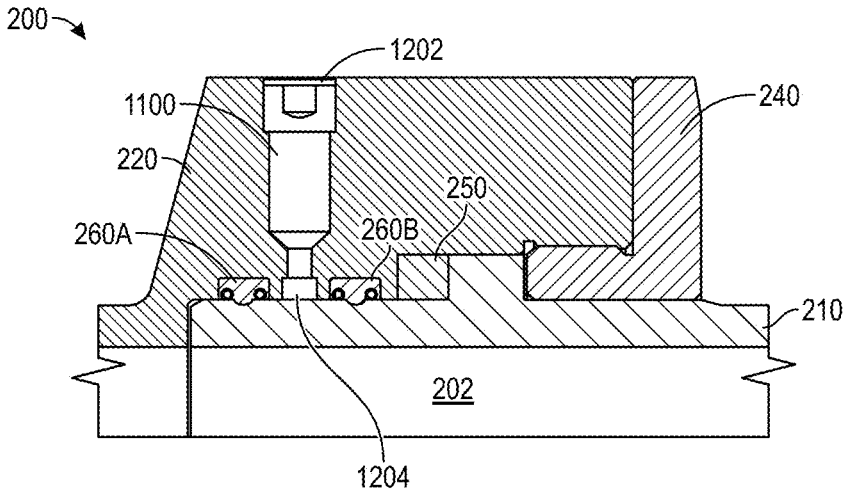
FIG. 12 illustrates a side, cross-sectional view of the swivel of FIG. 11, according to an embodiment.

FIG. 12 illustrates a side, cross-sectional view of the swivel 200 of FIG. 11, according to an embodiment. In this embodiment, the injection port 1100 extends radially through the top sub 220, as shown. Additionally, a cavity 1204 is defined between the mandrel 210 and the top sub 220, e.g., cut into the top sub 220 and extending radially outward from the interface with the mandrel 210. The cavity 1204 may communicate with the injection port 1100. Further, the cavity 1204 may be located axially between the seals 260A, 260B, and above the bearing 250. The axial cross-section illustrated may be circumferentially between adjacent holes 214 and locking pin bores 216, which are thus not shown in this view (i.e., they are rotated out of view). Sealant, which may cure into a solid or semi-solid, may be injected into the cavity 1204 via the injection portion 1100, so as to provide a redundant sealing element for sealing the interface between the mandrel 210 and the top sub 220. A sealant cap 1202 may be received into injection port 1100, which may be removed or otherwise adjusted to permit introduction of sealant into the cavity 1204 via the injection portion 1000.

In at least some embodiments, the cavity 1204, the injection port 1100, the seals 260A, 260B, and the bearing 260 may all be located "above" (e.g., uphole or farther away from the top of the wellbore) then the locking pin bores 216 (e.g., FIG. 9). That is, using the orientation of FIG. 1, these elements are closer to the CHH 110 than the locking pin bores 216 are.

Figure 13:
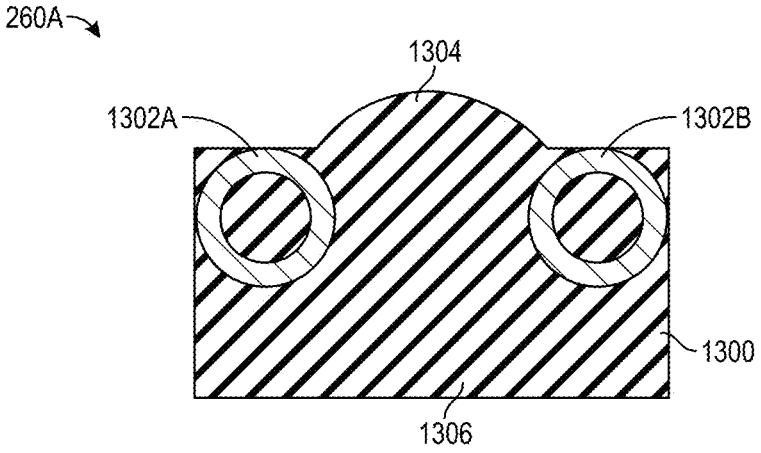
FIG. 13 illustrates a cross-sectional view of a seal of the swivel, according to an embodiment.

Additionally, the seals 260A, 260B may be gas seals. A cross-sectional view of the seals 260A, which may also be representative of an embodiment of the seal 260B, is shown in FIG. 13. In this view, it can be seen that the seal 260A may include a main body 1300 made of a relatively hard, elastomeric material, and a pair of springs 1302A, 1302B embedded at least partially in the main body 1300. The main body 1300 may define a protrusion 1304, which may be configured to extend into connection with the mandrel 210. Accordingly, a bottom 1306 of the seal 260A may be received into a groove formed in the top sub 220, although it will be appreciated that this orientation of the bottom 1306, the protrusion 1304 may be reversed, while the groove may be located in the mandrel 210 rather than or in addition to the top sub 220.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A surface swivel for use in a wellhead, the surface swivel comprising:

a mandrel configured to be connected to a first wellhead component, wherein the mandrel defines a plurality of holes arranged in a first angular interval and a second angular interval, wherein the holes in the first angular interval are closer together than the holes in the second angular interval;

a sub configured to be connected to a second wellhead component, wherein a portion of the mandrel is positioned within the sub and another portion extends axially from the sub, wherein a bore extends radially through the sub; and a connector configured to extend radially through the sub and to engage the mandrel so as to prevent relative rotation between the mandrel and the sub while the mandrel is being connected to the first wellhead component, while the sub is being connected to the second wellhead component, or both, and wherein the connector is configured to be removed from engagement with the mandrel so as to allow rotation between the mandrel and the sub.

2. The surface swivel of claim 1, wherein the connector is received through the bore and into one of the holes, so as to prevent relative rotation between the mandrel and the sub.

3. The surface swivel of claim 1, wherein the connector is received through the bore and one of the holes defined in the first angular interval.

4. The surface swivel of claim 1, further comprising a second connector configured to be received through a second bore extending radially through the sub, the second connector being received into another of the holes in the first angular interval.

5. The surface swivel of claim 1, further comprising a first seal between the mandrel and the sub and a second seal between the mandrel and the sub, the first and second seals being separated axially apart.

6. The surface swivel of claim 5, wherein a cavity is defined axially between the first seal and the second seal, and wherein an injection port is defined radially through the sub and in communication with the cavity, the injection port being configured to receive a sealant therethrough and into the cavity.

7. The surface swivel of claim 1, wherein the connector is receivable through the bore and into a torque-transmitting connection with the mandrel at a plurality of discrete, separated locations, and not receivable into the torque-transmitting connection with the mandrel between the plurality of discrete, separated locations.

8. The surface swivel of claim 1, wherein the first wellhead component comprises a casing or a casing landing base, and wherein the second wellhead component comprises a casing head housing.

9. The surface swivel of claim 1, further comprising a bearing positioned axially and radially between the mandrel and the sub, wherein the bearing permits the mandrel to rotate with respect to the sub while the swivel is under axial compression.

10. The surface swivel of claim 1, further comprising a retainer cap that is configured to be positioned at least partially within the bore, and wherein the retainer cap is configured to be positioned radially-outward from the connector when the connector is in the bore.

11. A method for making-up and operating a wellhead, the method comprising:

connecting a sub of a swivel to a first wellhead component;

connecting a mandrel of the swivel to a second wellhead component, wherein a bore extends through the sub, wherein a hole is defined at least partially in the mandrel and aligned with the bore, and wherein a connector extends through the bore and into the hole so as to prevent relative rotation between the sub and the mandrel while the swivel is being connected to the first and second wellhead components;

removing the connector from the swivel after the swivel is connected to the first and second wellhead components, so as to permit relative rotation between the mandrel and the sub; and landing a casing string hanger system in the first wellhead component after removing the connector.

12. The method of claim 11, wherein the first wellhead component comprises a casing head housing, and wherein the second wellhead component comprises a casing or a casing landing base.

13. The method of claim 11, further comprising introducing a retainer cap into the bore of the sub of the swivel after the connector is removed, wherein the retainer cap is introduced into the bore at a location that is radially-outward of where the connector was positioned.

14. The method of claim 11, further comprising injecting a sealant through an injection port formed in the sub, into a cavity formed in the sub that is axially between first and second seals positioned to form a sealing engagement between the sub and the mandrel.

15. A method for making-up and operating a wellhead, the method comprising:

connecting a sub of a swivel to a first wellhead component;

connecting a mandrel of the swivel to a second wellhead component, wherein a bore extends through the sub, wherein a hole is defined at least partially in the mandrel and aligned with the bore, and wherein a connector extends through the bore and into the hole so as to prevent relative rotation between the sub and the mandrel while the swivel is being connected to the first and second wellhead components;

removing the connector from the swivel after the swivel is connected to the first and second wellhead components, so as to permit relative rotation between the mandrel and the sub; and rotating the first wellhead component and the sub with respect to the mandrel after the connector is removed.

16. A surface swivel, comprising:

a sub configured to be connected to a first wellhead component, wherein the sub defines a plurality of locking pin bores radially therethrough;

a mandrel configured to be connected to a second wellhead component, the mandrel being received at least partially within the sub so as to form a flowpath through the sub and the mandrel, wherein the mandrel defines a plurality of holes extending at least partially therein, and wherein the holes are axially aligned with the locking pin bores, wherein there are more of the plurality of holes than the plurality of locking pin bores, and wherein the mandrel defines a first angular interval and a second angular interval, the plurality of holes being closer together in the first angular interval than in the second angular interval; and a plurality of connectors received through circumferentially-aligned pairs of the locking pin bores and into the holes, wherein the plurality of connectors are configured to provide a torque-transmitting connection between the sub and the mandrel, and are removable to permit relative rotation between the sub and the mandrel, and wherein the plurality of connectors are configured to lock the swivel at a plurality of discrete, separate locations and not between the plurality of discrete, separate locations.

17. The surface swivel of claim 16, further comprising:

a first seal and a second seal, the first and second seals forming a sealing engagement between the mandrel and the sub;

a cavity formed axially between the first seal and the second seal;

an injection port extending through the sub and in communication with the cavity, the injection port being configured to receive a sealant therethrough and into the cavity; and an axial bearing between the mandrel and the sub configured to permit relative rotation therebetween while the mandrel and the sub are compressed axially together, wherein the first seal, the second seal, the cavity, and the bearing are axially above the plurality of holes.

* * * * *